US006701589B1

(12) United States Patent
Kliewer

(10) Patent No.: US 6,701,589 B1
(45) Date of Patent: Mar. 9, 2004

(54) SHOE FASTENING DEVICES AND METHODS OF USE

(76) Inventor: Marie J. Kliewer, 6821 Henley Rd., Klamath Falls, OR (US) 97603

( * ) Notice: Subject to any disclaimer, the term of this patent is extended or adjusted under 35 U.S.C. 154(b) by 0 days.

(21) Appl. No.: 10/429,315

(22) Filed: May 5, 2003

Related U.S. Application Data

(60) Provisional application No. 60/457,368, filed on Mar. 26, 2003.

(51) Int. Cl.[7] ..... A43C 11/22

(52) U.S. Cl. ..... 24/712; 24/713.6; 24/715.3

(58) Field of Search ..... 24/712, 715.3, 24/DIG. 31, 575.1, 578.1, 713, 713.6, DIG. 35, 370, 102 SL, 712.1; 36/50.1, 51

(56) References Cited

U.S. PATENT DOCUMENTS

| | | | | |
|---|---|---|---|---|
| 146,913 | A | | 1/1874 | Keith |
| 562,114 | A | | 6/1896 | Benford |
| 565,884 | A | * | 8/1896 | Emmons |
| 1,184,647 | A | * | 5/1916 | Holloway |
| 1,595,630 | A | | 8/1926 | Stockton |
| 1,934,455 | A | * | 11/1933 | Staude et al. |
| 1,966,135 | A | | 7/1934 | Reh |
| 2,264,644 | A | * | 12/1941 | Santangelo |
| 2,289,225 | A | | 7/1942 | Tonai |
| 2,689,991 | A | * | 9/1954 | Fedankiw et al. |
| 2,871,537 | A | * | 2/1959 | Hickerson |
| 3,193,950 | A | | 7/1965 | Liou |
| 3,701,572 | A | * | 10/1972 | Velasquez |
| 3,731,350 | A | | 5/1973 | Diebold ..... 24/140 |
| 5,230,171 | A | * | 7/1993 | Cardaropoli |
| 5,239,732 | A | | 8/1993 | Steven ..... 24/573.1 |
| 5,465,442 | A | * | 11/1995 | Merser |
| 5,692,276 | A | | 12/1997 | Paxton ..... 24/713.6 |
| 5,737,811 | A | | 4/1998 | Rashid ..... 24/713 |

FOREIGN PATENT DOCUMENTS

FR 2551957 A * 3/1985

OTHER PUBLICATIONS

Assisted Devices Search Results Internet site at http://sandiegotext.networkoffcare.org.

* cited by examiner

*Primary Examiner*—James R. Brittain
(74) *Attorney, Agent, or Firm*—Lori M. Friedman

(57) ABSTRACT

The invention related to a shoe fastening device and methods for its use. The device comprises a double ended clip hook with a flattened, contoured c-shape hook at both its two ends. An elastomeric fastener is grasped at one hook end of the double ended clip hook which is inserted manually into one of a pair of eyelets over the tongue of the shoe and then the elastic is stretched to the second eyelet of the pair to be securely held by the other hook end. Identifying tags or decorations can be a part of the fastener to be used with children's shoes or to identify an elderly or infirm wearer. Shoes that may utilize the device of this invention include oxfords, walking shoes, sneakers, athletic shoes, and boots designed for lacing.

14 Claims, 2 Drawing Sheets

SHOE FASTENING DEVICES AND METHODS OF USE

RELATED PATENT APPLICATIONS

This is a United States patent application based on U.S. provisional patent application No. 60/457,368 filed on Mar. 26, 2003.

BACKGROUND OF THE INVENTION

1. Field of the Invention

The present invention relates to unique devices for fastening shoes. More specifically, the invention is concerned with simple and efficient means of fastening a shoe that is traditionally fastened by tying shoe laces. The present invention allows shoes to be fastened without the use of shoe laces and may be a benefit to those who lack manual dexterity. It also solves the problems of missing or broken shoe laces.

2. Background and Related Art

There is quite a bit of information on various ways to fasten eyelet shoes. Besides traditional shoe laces, there have been inventions concerned with fastening shoes by various means.

One of these alternate shoe fastening devices is described in U.S. Pat. No. 5,692,276 to Paxton. Described therein is a two-part clip, which is distinct from the elastomeric/double sided contoured clip hook that is the basis of the instant invention. Another patent to Diebold, U.S. Pat. No. 3,731,350 describes a lace tensioning device. The present invention describes a way to totally avoid the use of shoelaces in any form. U.S. Pat. No. 5,239,732 to Steven discloses an adjustable non-tying resilient securing apparatus for shoes. Although the Steven device is for non-tying of shoes, the opposing eyelets and gripping members are distinct from Applicant's invention disclosed herein.

In an on-line search of non-patented shoe closures a web site of the San Diego network of care organization uncovered several items concerning elastic shoe laces are listed. No figures are presented on the web site and the description "elastic laces" are quite distinct from the shoe fastening devices of this invention.

Many patents have been found that have issued in the twentieth century and even one as far back as 1874 that disclose various combinations of elastics, hooks, and wires to fasten shoes. None of the prior art has solved the shoe-fastening dilemma in the same way that is described herein.

SUMMARY OF THE INVENTION

The instant invention employs a distinctly designed, double ended contoured clip hook which, in conjunction with an elastic member that is stretched across a pair of eyelets in a shoe designed for laces, securely and comfortably holds the elastic in place over the tongue of the shoe. When used in each eyelet pair of the shoe, the invention transforms the shoe into a slip on type of shoe which does not need shoe laces to hold the shoe on a foot. The invention eliminated the problem of wearing lace-up shoes for people with manual dexterity problems. It also avoids the safety issues that may arise from broken shoelaces. In addition, decorative and/or identifying tags can be part of the shoe fastening device of this invention. This could be valuable in the case of children's shoes and if used by the elderly who may have memory loss due to illness such as Alzheimer's disease.

DETAILED DESCRIPTION OF PREFERRED EMBODIMENTS

Figure 3:
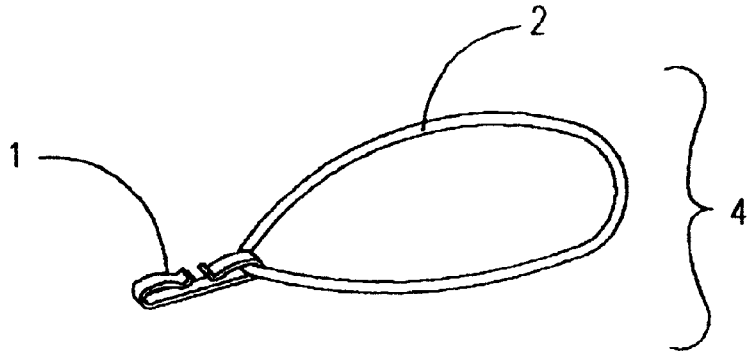
FIG. 3 is a double-sided contoured clip hook shown with an elastomer attached to one of the two sides of the hook.
Figure 4:
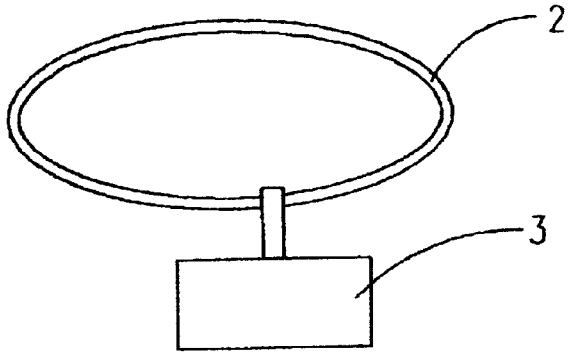
FIG. 4 is an elastomeric o-ring with optional decorative or identifying information that is connected thereto indicated by a rectangular box.
Figure 5:
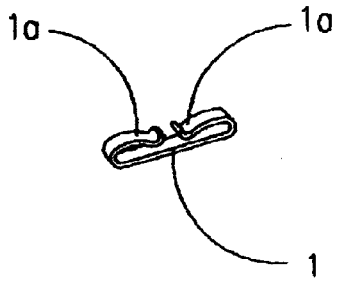
FIG. 5 is a double-sided contoured clip hook of this invention.

The present invention, as pictured in FIGS. 3, 4, and 5 show a double-ended clip hook 1, that is made of a light weight malleable metal that is formed using hand tools into a contoured, flattened c-shape hook 1*a* formed at both ends 1*a*. The entire length of the double-ended clip hook 1 is in the range of about one and one-half to three inches, the first half of said length is straight and the same size as the horizontal distance between a pair of matching eyelets 6 of a shoe 5 and the second half being formed into two flattened, contoured c-shaped hook ends 1*a* directly under the first half.

A closer look at the double-ended clip hook 1 of this invention shows that the width of its widest opening of the hook ends 1*a* is about twice the width of its narrowest opening. The difference between the widths of the openings of the hook ends 1*a* is designed to capture, clasp and securely hold the elastic 2 shown in FIG. 4.

The elastic 2 is of a shape which is circular of oval. It is designed to fit over the tongue 7 of the shoe 5 and is grasped between the two hooked ends 1*a* of the double-ended clip hook 1 which is inserted with the fingers, elastic first, into one of a matching pair of eyelets 6. Different sizes of elastics 2 are used depending on the width of the shoe 5 and the comfort of the wearer. Sizes of the elastic 2 can range from about 1¼ to about 2½ inches in diameter and which are about ⅛ inch thick.

Elastomers from which the elastic 2 can be made include a plurality of commonly found stretchable ring-shaped items including circular o-rings, reinforced rubber bands, and pony-tail holders. Circular o-rings are available from O-Rings West, Inc. Rubber bands and pony-tail holders are widely available from variety and general merchandise stores.

The double-ended clip hook 1 may be made from a variety of light weight malleable metal selected from the group consisting of aluminum, zinc, and a pot metal alloy that can be easily molded into the contoured clip two-hook 1 shape needed to securely hold the elastic 2 inserted in each hook end 1*a* of the double-ended contoured clip hook 1. In order to use the shoe fastening device of this invention, which is pictured in FIG. 4, as the double-ended contoured clip hook 1 with a hook end 1*a* on both sides fitted with an elastic 2 the following is done: the elastic 2 is manually put into one end of the double-ended contoured clip hook 1*a* with the fingers, then the clip hook elastomer combination 4 is inserted manually into a first shoe eyelet 6 and then pushed through a second, horizontally opposing shoe eyelet 6, after which the unattached end of the elastic 2 is stretched over the space between the horizontal pair of eyelets 6 over the shoe's tongue 7 and manually hooked into the open contoured clip hook end 1*a*. In this manner, the two eyelets 6 of one horizontal pair of eyelets of the shoe 5 are connected. This procedure is repeated until all the pairs of eyelets 6 of the shoe 5 are connected.

Figure 1:
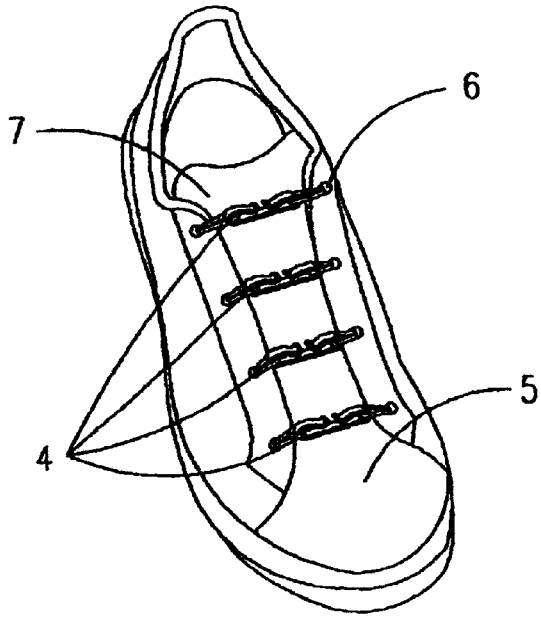
FIG. 1 depicts an oxford walking shoe with four eyelets that is fastened by a plurality of contoured clip hook and elastomer combinations.
Figure 2:
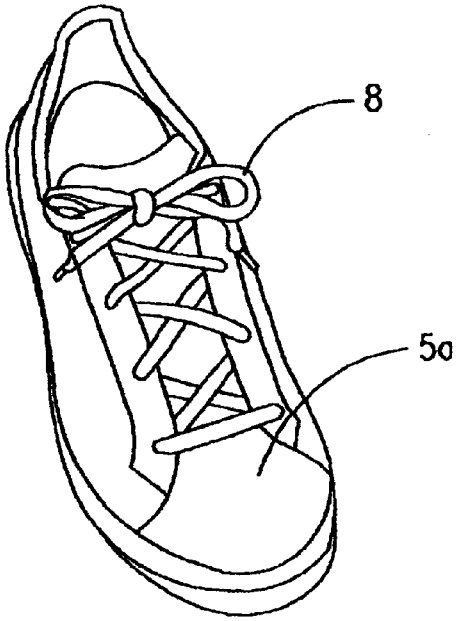
FIGURE 2 PRIOR ART
FIG. 2 depicts a matching oxford walking shoe with four eyelets that is fastened by a shoelace.

In this manner, a shoe 5*a* that was designed to be laced with shoe laces 8, as shown in FIG. 2 as prior art, is now a slip-on shoe. The slip on design of shoe is oftentimes more comfortable than a laced shoe 5*a*, and if the shoe 5 is fastened using the device of this invention 4, it will mold comfortably to the foot and not be too loose or too tight. The shoe 5 can remain fastened at all times and the foot of the wearer can be inserted and removed easily. The elastic 2 part of the device 4 can stretch to allow foot insertion and removal. Any shoe 5*a* that is designed for laces 8 can be easily converted to use the fastening device 4 of this invention. The types of shoe that most often will be used include oxfords, walking shoes, sneakers, athletic shoes, and boots designed for lacing. The number of fasteners 4 will vary depending on the number of eyelets 6 present in the shoe 5. The number may usually range from 4 to 12 pairs of eyelets 6 but this number may vary and will not effect the essence of this invention. The shoe fastening device of this invention 4 is inserted and manipulated with the fingers. No special tool or device is needed to use the device. If the person wearing the shoe is a child, elderly, or a person needing care, the procedure may be performed by a parent or caregiver Identifying and/or decorative materials 3 may be connected to the device 4 of this invention in a variety of ways including attaching it to the elastic 2 or bonding it to the double-ended clip hook 1. The device may identify the wearer. This may be very useful if the shoe is worn by a child who gets lost or an elderly person who may experience memory loss.

Stress areas of the device 4 of this invention may be in both clip hook end 1*a*. If desired, a thin coating of rubber or other protective material may be applied to clip hook ends 1*a*. The shoe fastening device 4 may be made of plastic instead of malleable metal; this may be quite applicable if the device is produced commercially in a factory and/or as the original shoe fastener (instead of shoelaces). The shoe fastening device 4 must be resistant to breakage and cracking and have no sharp edges.

A particularly preferred embodiment of the present invention has a double-ended contoured clip hook 1 that is about one and one half to three inches long with a hook end 1*a* on both sides that is about ⅛ inch at its widest point and about 1/16 inch wide at its narrowest point. The elastomer 2 that fits into each clip hook end 1*a* is an o-ring with a diameter of about 1½ inches

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A removable device for fastening shoes, said shoes having a plurality of successive horizontal pairs of eyelets over a tongue between a foot of a wearer and the eyelets which are designed for closure with shoe laces comprising a. a continuous, elongated circular elastomeric shape and b. a double-ended clip hook each of which has a flattened, contoured c-shaped hook on each of its two ends, that form a slight opening and whose contoured shape accepts and securely grasps the elastomeric shape inserted therein so that said elastomeric shape is only secured to said double ended hook at said ends, the number of said elastomeric shape and double-ended clip hook combinations matches the number of successive horizontal pairs of eyelets in the shoe; which pairs are inserted in each pair of the shoe's eyelets which results in a shoe that is stretched to allow insertion of the foot and after said insertion results in the foot being fixed firmly in the shoe.

2. The removable device of claim 1 wherein the pairs of elongated elastomeric shapes and double ended contoured clip hooks remained fastened when attached on the shoe and allow the shoe to be removed from a foot by stretching the tongue of the shoe over the foot and removing the foot.

3. The removable device of claim 1 wherein the shoe remains fastened on the foot of a wearer as long as the plurality of elastomeric shapes and double-ended contoured clip hooks are joined together as the shoe's fastening means.

4. The removable device of claim 3 wherein the joined elastomeric shapes and double-ended contoured clip hooks insure that the shoe's wearer will not lose parts of the fastening means during wear and when the foot is removed from the shoe.

5. The removable device of claim 1 wherein the plurality of elongated elastomeric shapes are selected from the group consisting of circular o-rings, reinforced rubber bands, and pony tail holders.

6. The removable device of claim 1 wherein each double-ended contoured clip hook is made of a light weight malleable metal selected from the group consisting of aluminum, zinc and a pot metal alloy that can be easily molded into the contoured double-ended clip hook shape needed to securely hold the elongated elastomeric shape inserted in each side of the double-ended contoured clip hook.

7. The removable device of claim 1 wherein the elongated elastomeric shapes and double ended clip hook combinations that are fitted into the shoe's eyelet pairs allow a shoe manufactured for closure with shoe laces to be a slip-on shoe.

8. The removable device of claim 1 wherein the identity of the wearer is provided on an Identifying tag is attached to it that identifies the wearer in case of emergency.

9. The removable device of claim 1 wherein the shoes that are fastened are selected from the group consisting of oxfords, walking shoes, sneakers, athletic shoes, and boots designed for lacing.

10. A method for securely fastening a fitted shoe that has a plurality of successive horizontal pairs of eyelets over a tongue between the foot and the eyelets which are designed for closure with shoe laces comprising the steps of a) first placing an elongated elastomeric shape in one end of a double-ended clip hook with a contoured, flattened hook formed on each of two ends before insertion in shoe;

b) then inserting the elongated elastomeric shape and double-ended clip hook combination, elastomer first, into the first eyelet of a horizontal eyelet pair of the shoe;

c) then grasping the loose end of the elongated elastomer by the second end of the first contoured clip hook that has previously been inserted in the shoe eyelet;

d) then extending the elongated elastomeric shape into over the space between the two eyelets of the eyelet pair;

e) lastly inserting the loose end of the elongated elastomer to the second end of the contoured clip hook; and f) repeating the five above steps for each horizontal eyelet pair until the shoe is fastened on the foot.

11. The method of claim 10 whereby the shoe that is designed for fastening with shoe laces is fastened by a plurality of elastic and contoured clip hook pairs, one contoured clip hook and elastomer for each set of eyelets in the shoe.

12. The method of claim 10 whereby a shoe designed for lacing with shoe laces is put on and removed as a slip-on shoe that can remain fastened at all times and the foot of the wearer can be inserted and removed easily and thus affords a comfortable fit by the shoe's molding comfortably to the foot and not be too loose or too tight.

13. The method of claim 10 wherein the identity of a person wearing the shoe is provided on an Identifying tag is attached to it that identifies the wearer in case of emergency.

14. The method of claim 10 wherein the shoes that are fastened are selected from the group consisting of oxfords, walking shoes, sneakers, athletic shoes, and boots designed for lacing.

* * * * *